US012089791B2

(12) United States Patent
Danis et al.

(10) Patent No.: US 12,089,791 B2
(45) **Date of Patent: *Sep. 17, 2024**

(54) DISPENSING ASSEMBLY FOR PAPER PRODUCTS

(71) Applicant: Christopher J. Danis, Centerville, OH (US)

(72) Inventors: Christopher J. Danis, Centerville, OH (US); Matthew J. Vallo, Dayton, OH (US); Gabrielle M. Jackson, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/377,603

(22) Filed: Oct. 6, 2023

(65) Prior Publication Data

US 2024/0032740 A1 Feb. 1, 2024

Related U.S. Application Data

(63) Continuation of application No. 18/111,628, filed on Feb. 20, 2023, now Pat. No. 11,812,897.

(60) Provisional application No. 63/392,240, filed on Jul. 26, 2022, provisional application No. 63/312,041, filed on Feb. 20, 2022.

(51) Int. Cl.
*A47K 10/38* (2006.01)
*A47K 10/32* (2006.01)

(52) U.S. Cl.
CPC ..... *A47K 10/38* (2013.01); *A47K 2010/3233* (2013.01); *A47K 2010/3266* (2013.01)

(58) Field of Classification Search
CPC ..... A47K 2010/3681; A47K 10/38; A47K 10/426; A47K 2010/3206; A47K 2010/3286; A47K 2010/3233; A47K 2010/3266
USPC ..... 221/33–63, 197
See application file for complete search history.

(56) References Cited

U.S. PATENT DOCUMENTS

| | | | | |
|---|---|---|---|---|
| 5,697,577 | A * | 12/1997 | Ogden | A47K 10/38 242/596.8 |
| 5,897,074 | A * | 4/1999 | Marino | A47K 10/38 242/596.8 |
| 7,887,005 | B2 * | 2/2011 | Troutman | A47K 10/36 242/563.2 |
| 11,051,663 | B1 * | 7/2021 | Danis | A47K 10/3612 |
| 11,812,897 | B1 * | 11/2023 | Danis | A47K 10/36 |
| 2007/0034638 | A1 * | 2/2007 | Zeiron | A47K 10/427 221/52 |
| 2010/0314429 | A1 * | 12/2010 | Troutman | A47K 10/36 225/11 |

(Continued)

*Primary Examiner* — Timothy R Waggoner
(74) *Attorney, Agent, or Firm* — Frost Brown Todd LLP; Vance V. VanDrake, III; Alexander J. Johnson

(57) ABSTRACT

A dispensing assembly is disclosed herein. The dispensing assembly includes a housing comprising a plurality of side panels, a cartridge for dispensing a paper product; and actuation subassembly being disposed in the housing, the actuation subassembly configured to advance the paper product disposed in the cartridge; and a slidable drawer subassembly. The slidable drawer subassembly including a cartridge tray for removably receiving the cartridge, the slidable drawer subassembly being displaceable between a closed position where the cartridge is enclosed within the housing and an open position where the cartridge is able to be loaded or unloaded from the cartridge tray.

20 Claims, 14 Drawing Sheets

(56) References Cited

U.S. PATENT DOCUMENTS

| | | | | |
|---|---|---|---|---|
| 2013/0105614 | A1* | 5/2013 | Hjort | A47K 10/36 242/564.5 |
| 2013/0213995 | A1* | 8/2013 | Horel | A47K 10/424 221/197 |
| 2014/0076916 | A1* | 3/2014 | Boyce | A47K 10/3827 221/34 |
| 2015/0196174 | A1* | 7/2015 | Goltz | A47K 10/426 242/596 |

* cited by examiner

DISPENSING ASSEMBLY FOR PAPER PRODUCTS

CROSS-REFERENCE TO RELATED APPLICATIONS

This is a continuation of U.S. patent application Ser. No. 18/111,628, filed Feb. 20, 2023, which claims priority to U.S. Provisional Patent Application No. 63/312,041, entitled "Dispensing Assembly For Paper Products", filed on Feb. 20, 2022, and U.S. Provisional Patent Application No. 63/392,240, entitled "Dispensing Assembly For Paper Products", filed on Jul. 26, 2022, the disclosure of each of which is hereby incorporated by reference as if set forth in its entirety herein.

FIELD OF INVENTION

The present invention relates to a dispensing assembly for paper products and, more specifically, to a housing and a cartridge for dispensing pre-wetted paper products.

BACKGROUND

Many conventional combination dispensers for wet and dry paper products (e.g., toilet paper) occupy excessive amounts of space and do not provide convenient access to both the wet and dry paper products. In addition, current dispensers often do not allow for easy replacement or replenishment of the wet paper products by the consumer and fail to provide a barrier to loss of moisture from the wet paper products. Furthermore, some dispensers require installation of special-purpose holders, and dispensers that attach to existing wall-mounted holders may still require modification of the holder, the wall, or other adjacent structure to accommodate the dispenser. Many of these conventional dispensers are not recyclable or may contain one or more components that are not recyclable.

BRIEF SUMMARY OF EMBODIMENTS OF THE INVENTION

Accordingly, the present disclosure is directed to a dispensing assembly for paper products that substantially obviates one or more problems resulting from the limitations and deficiencies of the related art.

In accordance with one or more embodiments of the present disclosure, there is provided a dispensing assembly that includes a housing comprising a plurality of side panels; a cartridge for dispensing a paper product; an actuation subassembly being disposed in the housing, the actuation subassembly configured to advance the paper product disposed in the cartridge; and a slidable drawer subassembly, the slidable drawer subassembly including a cartridge tray for removably receiving the cartridge, the slidable drawer subassembly being displaceable between a closed position where the cartridge is enclosed within the housing and an open position where the cartridge is able to be loaded or unloaded from the cartridge tray. In a further embodiment of the present disclosure, the slidable drawer subassembly further comprises a double slide mechanism for allowing the cartridge tray to be displaced between the closed position and the open position.

In yet a further embodiment, when the slidable drawer subassembly is moved into the closed position, one or more rollers of the dispensing assembly are configured to compress the paper product dispensed from the cartridge.

In still a further embodiment, the dispensing assembly further comprises an active roller and a passive roller, the active roller being driven by the actuation subassembly, and the passive roller being spring-loaded so as to compress the paper product between the passive roller and the active roller.

In yet a further embodiment, the passive roller further comprises a plurality of spaced-apart grooves formed therein, each of the plurality of spaced-apart grooves being configured to receive a respective tooth member in the active roller to facilitate a reliable dispensing of the paper product.

In still a further embodiment, the dispensing assembly further comprises a mechanical release button for opening the slidable drawer subassembly of the dispensing assembly, the mechanical release button being operatively coupled to a spring-loaded mechanical latching device such that a depressing of the mechanical release button releases the spring-loaded mechanical latching device for allowing the slidable drawer subassembly to open.

In yet a further embodiment, the cartridge further comprises a first portion and a second portion, the first portion of the cartridge being hingedly connected to the second portion.

In still a further embodiment, the actuation subassembly comprises a drive gear and a drive motor, the drive gear being operatively coupled to the drive motor and to an active roller in the housing, and when a button is depressed on the housing, the drive gear and the active roller rotate a predefined rotational distance to advance the paper product.

In yet a further embodiment, the dispensing assembly further comprises a hanger component attached to the housing, the hanger component comprising a pair of arms that suspend the housing below a spindle.

In still a further embodiment, the hanger component comprises a plurality of attachment protrusions that are configured to snap into corresponding recesses formed in the housing so as to removably attach the hanger component to the housing.

In yet a further embodiment, the cartridge is configured to be inserted into a front of the housing by means of the slidable drawer subassembly.

In still a further embodiment, the paper product comprises cleaning wipes disposed on a roll.

In yet a further embodiment, the actuation subassembly comprises a drive gear, a drive motor, and a membrane switch pad, the drive gear being operatively coupled to the drive motor and to an active roller in the housing, the membrane switch pad comprising a first switch for rotating the drive gear and the active roller a predefined rotational distance so as to advance the paper product, a first indicator light for indicating a low battery condition of the dispensing assembly, a second indicator light for indicating a low sheet count of the paper product, and a second switch for resetting a wipe count to zero when a new cartridge is inserted into the dispensing assembly by a user.

In still a further embodiment, the dispensing assembly further comprises a sensor device configured to detect a portion of a sheet of the paper product after a prior sheet of the paper product has been torn off by a user, and cause the drive motor to reverse until no portion of the sheet is detected by the sensor device, thereby allowing for a smallest amount of sheet surface of the sheet to be exposed to air so as to reduce moisture loss from the sheet when the sheet has been pre-moistened.

In yet a further embodiment, the dispensing assembly further comprises an encoder provided on the drive motor to measure a number of revolutions of the active roller, an output signal of the encoder being used to indicate when to stop the drive motor from rotating so as to result in a sheet of the paper product being positioned correctly, thereby facilitating a proper detachment of the sheet for use.

In still a further embodiment, the dispensing assembly is configured to be mounted to a surface of a support structure, and the drive motor of the dispensing assembly is configured to be powered by a low voltage power source or a 120-volt building power source.

In yet a further embodiment, the dispensing assembly further comprises an electrical release button for opening the slidable drawer subassembly of the dispensing assembly, the electrical release button being operatively coupled to a solenoid latching device such that a depressing of the electrical release button releases a solenoid pin of the solenoid latching device for allowing the slidable drawer subassembly to open, the solenoid latching device configured to be powered by the low voltage power source or the 120-volt building power source.

In still a further embodiment, the dispensing assembly further comprises a heating element for heating the paper product in the cartridge, the heating element being mounted on one of the plurality of side panels of the housing next to the cartridge tray, and the heating element configured to be powered by the low voltage power source or the 120-volt building power source.

In yet a further embodiment, the dispensing assembly further comprises a touchless actuator or switch for dispensing the paper product from the dispensing assembly; and, when a user places his or hand in close proximity to the touchless actuator or switch, an active roller of the dispensing assembly is configured to be rotated a predefined rotational distance so as to advance the paper product, and dispense the paper product from the dispensing assembly.

In still a further embodiment, the cartridge comprises a cartridge extension portion extending outwardly a cartridge dispensing slot of the cartridge, the cartridge extension portion acting as a guide for the proper positioning of a leading edge of a first sheet of the paper product so as to set the proper positioning for the successive sheets of the paper product, and the cartridge extension portion being perforated so as to allow the cartridge extension portion to be separated from a remainder of the cartridge after the leading edge of the first sheet of the paper product has been properly positioned.

It is to be understood that the foregoing general description and the following detailed description of the present disclosure are merely exemplary and explanatory in nature. As such, the foregoing general description and the following detailed description of the present disclosure should not be construed to limit the scope of the appended claims in any sense.

BRIEF DESCRIPTION OF THE SEVERAL VIEWS OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

Throughout the figures, the same parts are always denoted using the same reference characters so that, as a general rule, they will only be described once.

DETAILED DESCRIPTION OF EMBODIMENTS OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 10A:
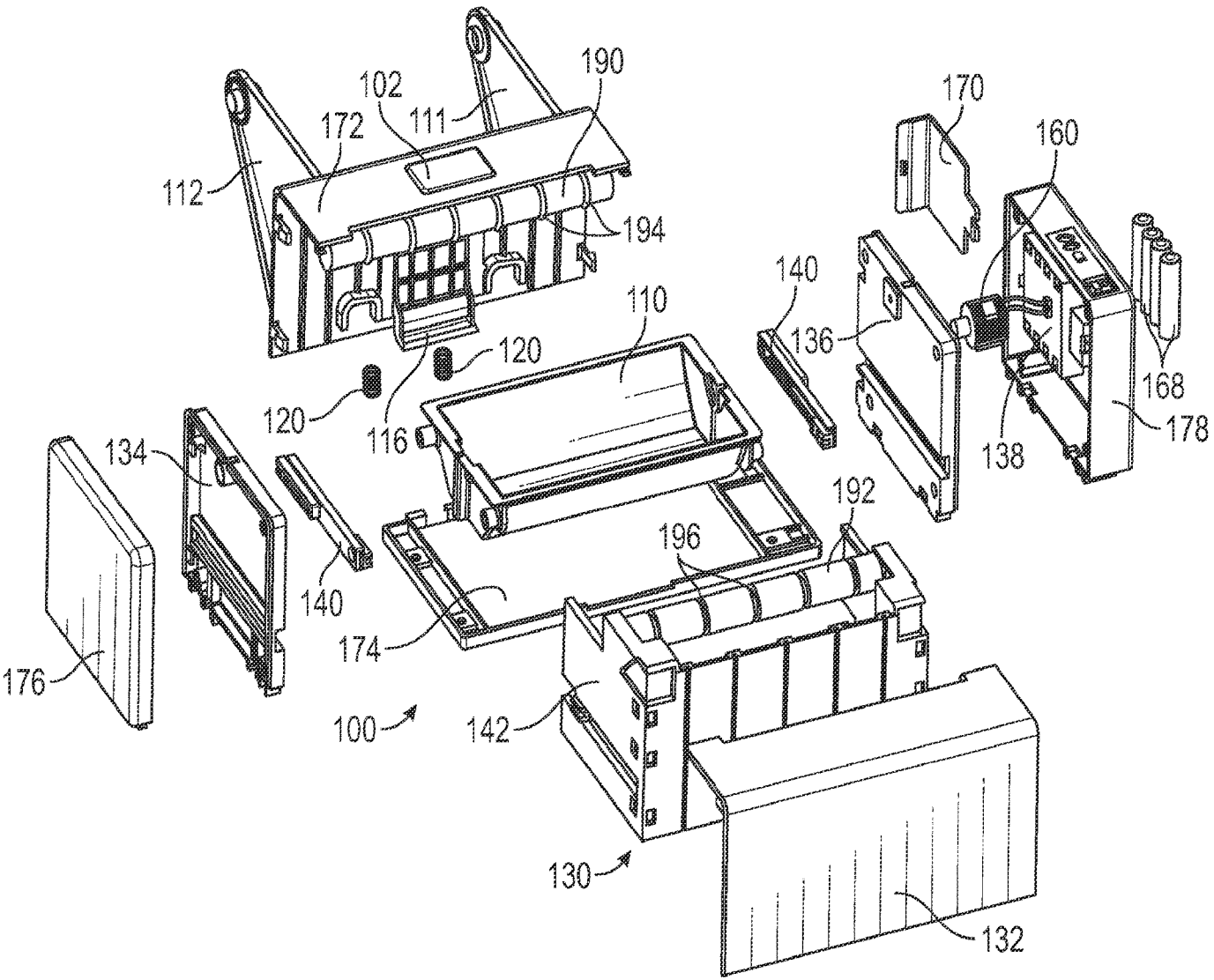
FIG. 10A is an exploded perspective view of the dispensing assembly of FIG. 2.

With reference to FIGS. 1A, 3, 4, and 5, a dispensing assembly 100 in accordance with a first illustrative embodiment of the present disclosure is depicted. The dispensing assembly 100 comprises a housing 104 and a cartridge 180. The housing 104 and the cartridge 180 may each comprise one or more polymeric materials and may comprise at least partially recycled and/or recyclable materials. The housing 104 may comprise a plurality of side panels that together define a compartment into which the cartridge 180 is removably received, as described herein. The housing 104 may comprise an elongate body portion 105 (see FIGS. 1A, 2, 5, and with the plurality of side panels 132, 172, 174 and a pair of end caps 176, 178 on opposed ends of the elongate body portion 105. As shown in FIG. 10A, the side panels 132, 172, 174 of the housing 104 comprise an L-shaped front wall 132, an L-shaped rear wall 172, and a bottom wall 174. The dispensing assembly 100 may further comprise an actuation subassembly being disposed in the housing (see FIG. 5), the actuation subassembly being configured to advance the paper product 101 disposed in the cartridge 180.

Figure 1A:
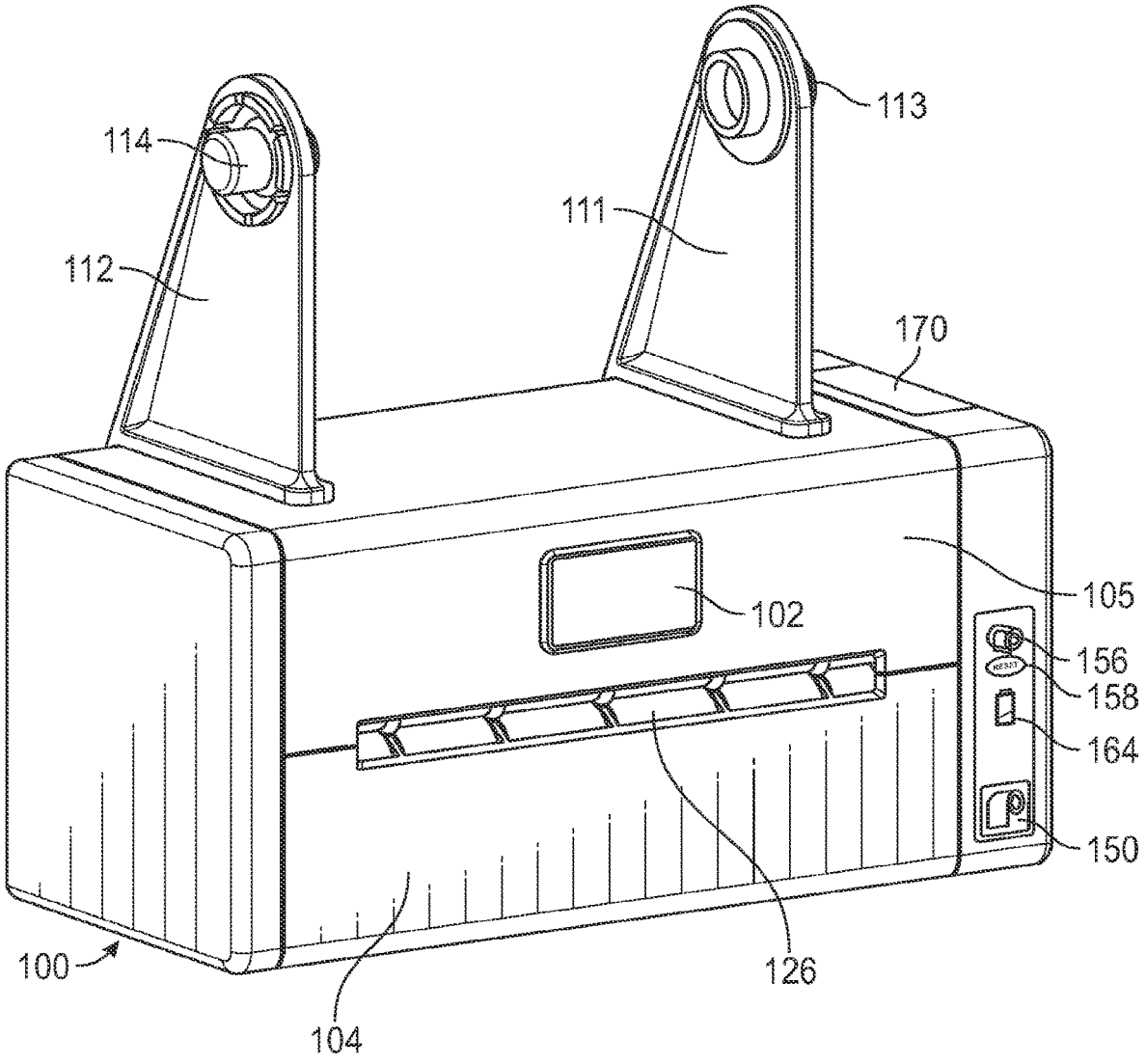
FIG. 1A is a front-top perspective view of a first illustrative embodiment of a dispensing assembly comprising a housing and a cartridge in accordance with principles of the present disclosure, wherein a first suspended configuration of the dispensing assembly is illustrated.
Figure 4:
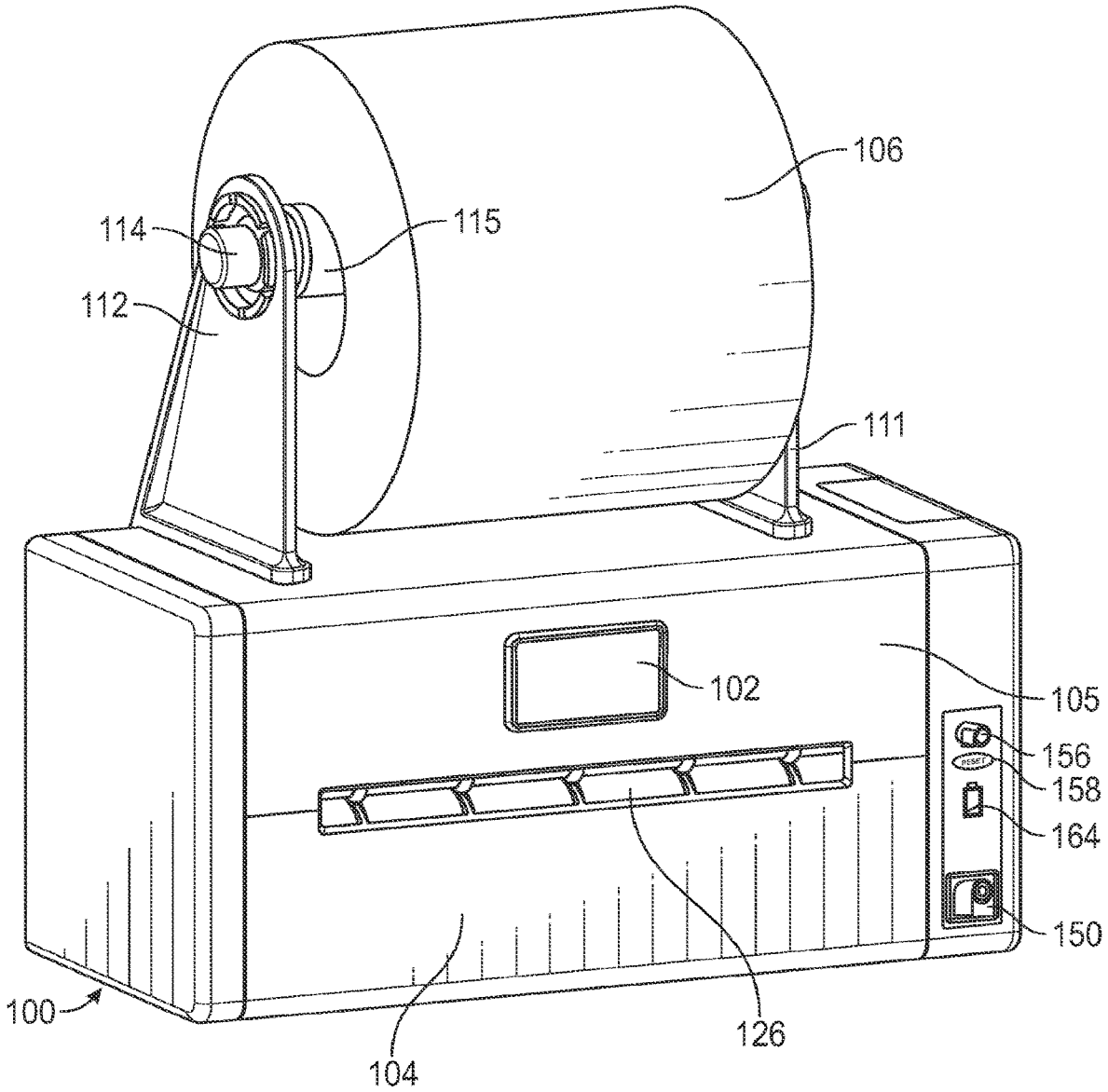
FIG. 4 is yet another front-top perspective view of the dispensing assembly of FIG. 1A, wherein the first suspended configuration of the dispensing assembly is illustrated with a toilet paper roll and spindle.
Figure 6:
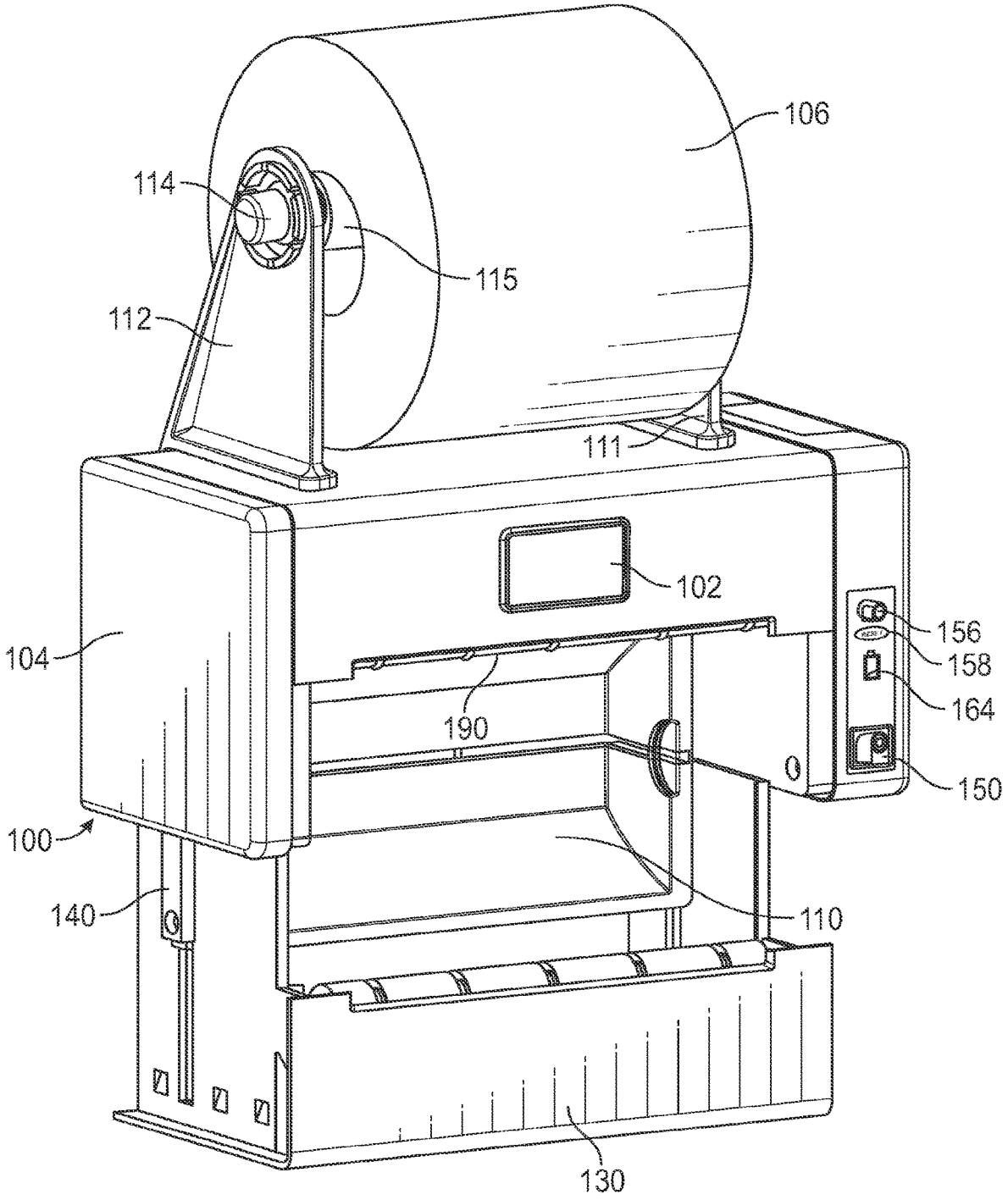
FIG. 6 is another perspective view of the dispensing assembly of FIG. 1A, wherein the slidable drawer subassembly of the housing is open so that a cartridge is able to loaded into the cartridge tray of the slidable drawer subassembly.

Referring again to FIGS. 1A, 4, and 6, it can be seen that the dispensing assembly 100 may further comprise a first type of hanger subassembly. The first type of hanger subassembly is attached to the top of the housing 104 (see FIGS. 1A and 4), and the first type of hanger subassembly comprises a pair of arms 111, 112 that may suspend the housing 104 below a spindle (e.g., a toilet paper roll core 115). The pair of arms 111, 112 extend upwardly in a generally perpendicular manner from an upper surface of the housing 104. The first arm 111 comprises a first attachment protrusion 113 and the second arm 112 comprises a second attachment protrusion 114 for hanging the dispensing assembly 100 from a toilet paper holder. Also, as shown in FIG. 1A, first arm 111 comprises an interior cradle for receiving a first end of the spindle 115, while the second arm 112 comprises an interior cradle for receiving a second oppositely disposed end of the spindle 115. As shown in FIGS. 4 and 6, the toilet tissue roll 106 may be placed on the spindle 115 and supported above the housing 104.

In the illustrative embodiment, the first attachment protrusion 113 may be part of a first removable insert and the second attachment protrusion 114 may be part of a second removable insert (e.g., the removable inserts have resilient prongs for snapping into the respective apertures in the arms 111, 112). The removable inserts allow the hanger subassembly to accommodate different configurations of toilet paper holders. For example, when the removable inserts are removed from the arms 111, 112, the hanger subassembly is able to accommodate an L-shaped toilet paper holder.

In the illustrative embodiment, each of the arms 111, 112 of the first type of hanger subassembly may comprise a plurality of attachment protrusions (e.g., a pair of attachment protrusions) that are configured to snap into corresponding recesses formed in the housing 104 so as to removably attach the hanger subassembly to the housing 104.

Figure 1B:
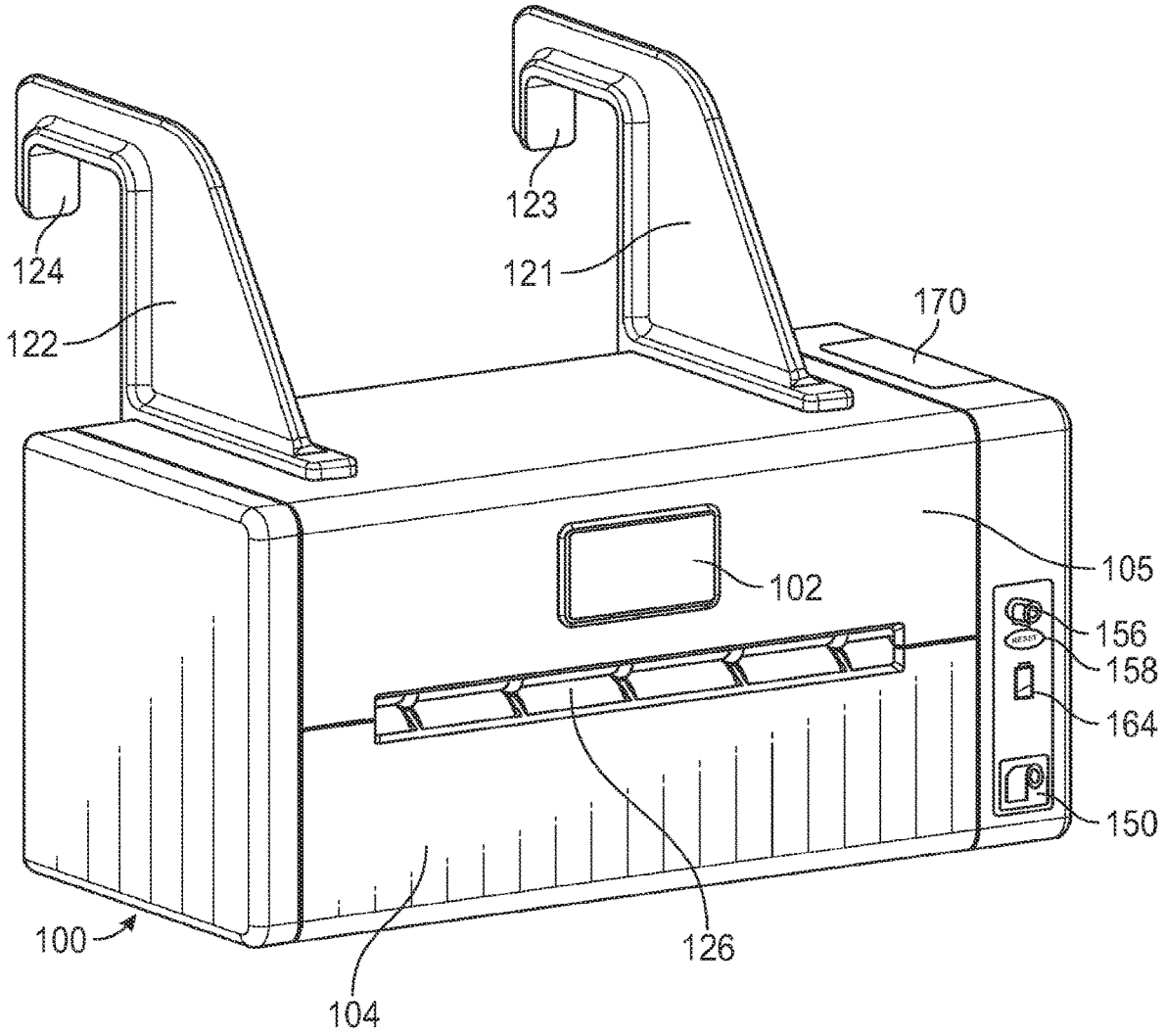
FIG. 1B is another front-top perspective view of the dispensing assembly of FIG. 1A, wherein a second suspended configuration of the dispensing assembly is illustrated.

Turning to FIG. 1B, in the illustrative embodiment, it can be seen that the dispensing assembly 100 may further comprise a second type of hanger subassembly. Like the first type of hanger subassembly, the second type of hanger subassembly is attached to the top of the housing 104 (see FIG. 1B), and the second type of hanger subassembly comprises a pair of arms 121, 122 that may suspend the housing 104 below a tabletop (e.g., the tabletop of a baby changing table). The pair of arms 121, 122 extend upwardly in a generally perpendicular manner from an upper surface of the housing 104. The first arm 121 comprises a first hook portion 123 and the second arm 122 comprises a second hook portion 124 for hanging the dispensing assembly 100 from the edge of a tabletop. For example, the first and second hook portions 123, 124 may be attached to a standard baby changing table by hooking onto the edge of the changing table.

In the illustrative embodiment, similar to the first type of hanger subassembly, each of the arms 121, 122 of the second type of hanger subassembly may comprise a plurality of attachment protrusions (e.g., a pair of attachment protrusions) that are configured to snap into corresponding recesses formed in the housing 104 so as to removably attach the hanger subassembly to the housing 104.

Figure 2:
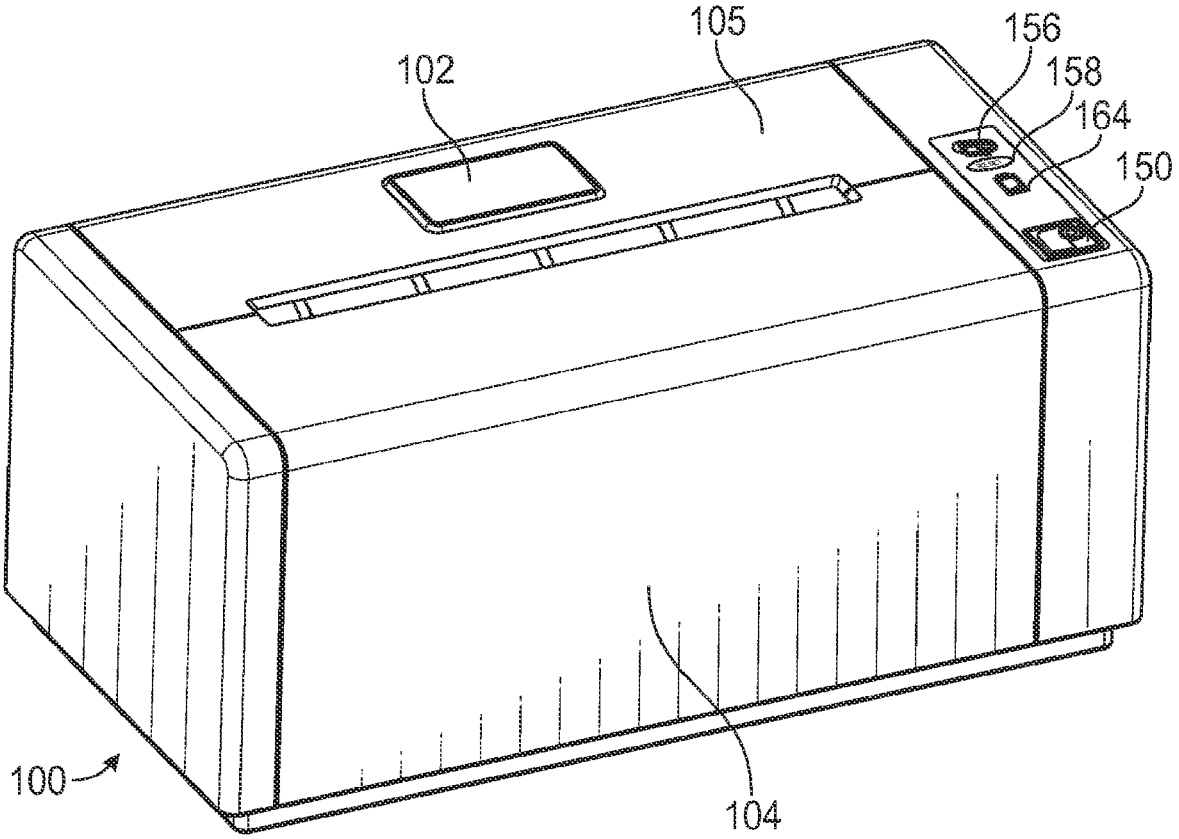
FIG. 2 is another front-top perspective view of the dispensing assembly of FIG. 1A, wherein a tabletop configuration of the dispensing assembly is illustrated.

As shown in FIGS. 1A, 4, and 6, the first configuration of the dispensing assembly 100 comprises the first and second arms 111, 112 for suspending the housing 104 below a toilet paper roll spindle, while the third configuration of the dispensing assembly 100 is designed to rest on a support surface (e.g., a tabletop surface—see FIG. 2). In the illustrative embodiment, the dispensing assembly 100 may be provided with a plurality of support feet (e.g., four (4) polymeric pads) in each corner on the bottom of the housing 104 for allowing the dispensing assembly 100 to rest on a tabletop, countertop, changing table, or other horizontal surface.

Figure 9A:
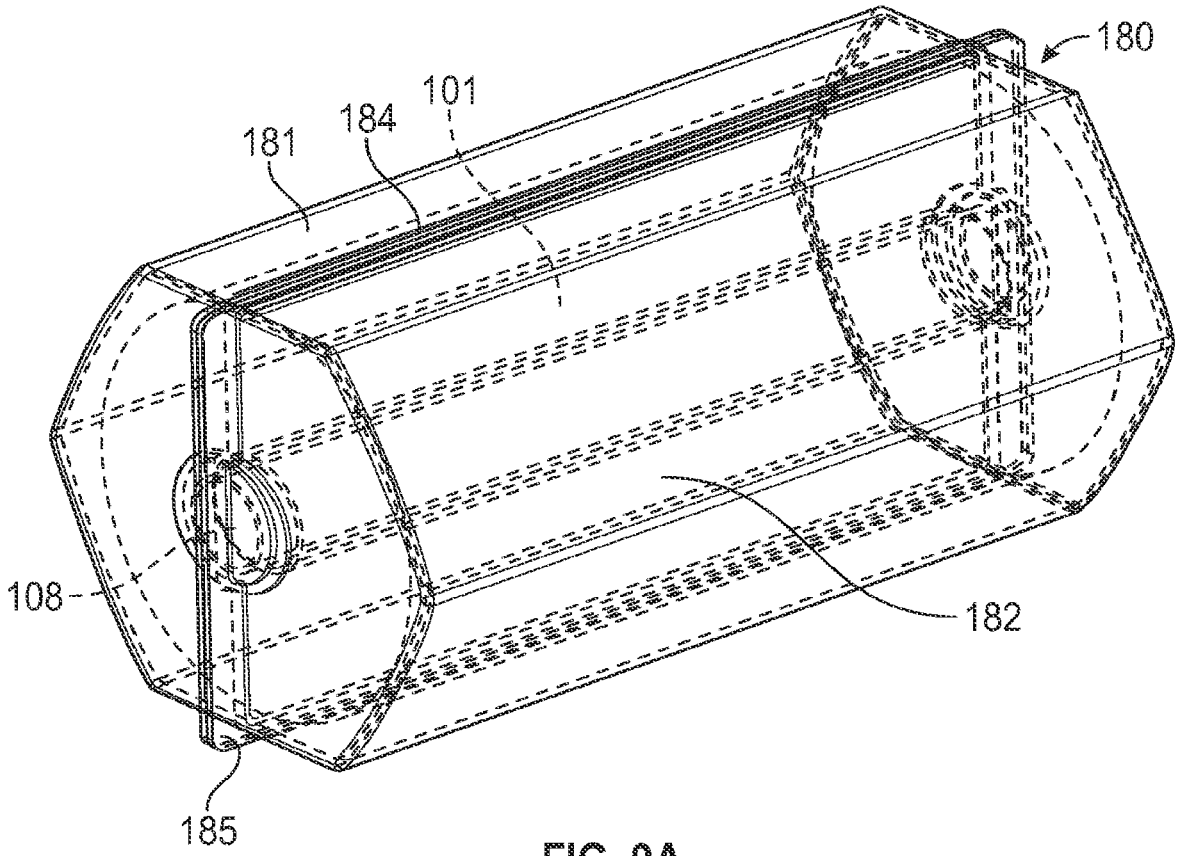
FIG. 9A is a perspective view of a cartridge of the dispensing assembly of FIG. 1A, wherein a roll of a paper product is disposed in the cartridge, and a cartridge extension portion of the cartridge has been removed.

With reference to FIG. 9A, the cartridge 180 comprises a first portion 181 and a second portion 182. In the illustrative embodiment, the first portion 181 may be coupled to the second portion 182 in a clamshell-type configuration. More particularly, in the illustrative embodiment, the first portion 181 may be coupled to the second portion 182 by a hinge 185 extending longitudinally along the elongate rear side of the cartridge 180. The hinge 185 may be integrally formed with the cartridge 180 (i.e., be in the form of a living hinge), or may comprise a strip of thin, flexible material adhered to the cartridge 180 and spanning between the first portion 181 and the second portion 182. The first portion 181 of the cartridge 180 may pivot along the hinge 185 to allow access to an interior space of the cartridge 180.

Figure 3:
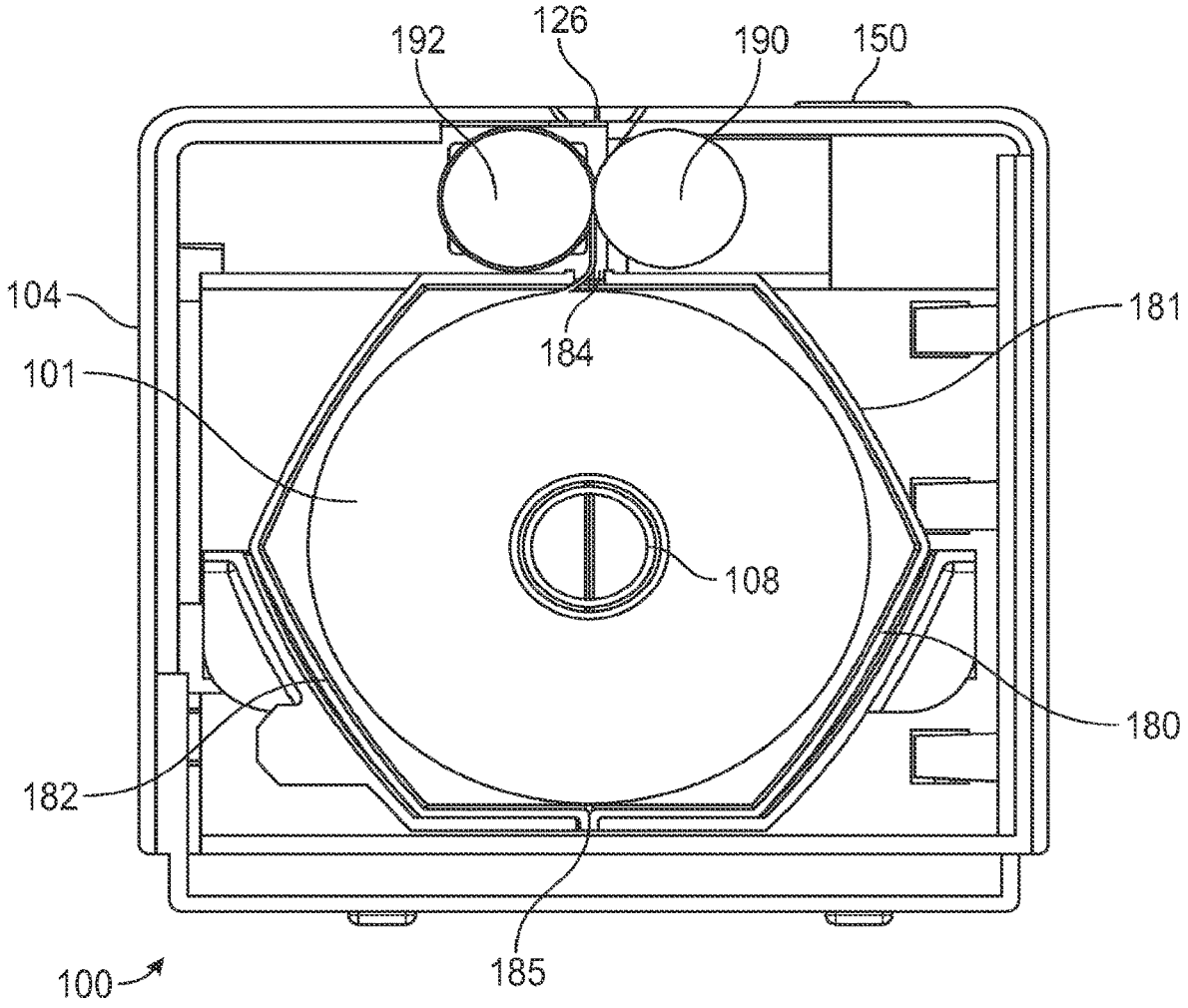
FIG. 3 is a transverse sectional perspective view of the dispensing assembly of FIG. 2.

The cartridge 180 may be for dispensing a paper product 101, as shown in FIG. 3. The cartridge 180 may accommodate a variety of wet paper products and may be refillable. The paper product 101 may comprise, for example, a rolled, continuous sheet of a pre-wetted paper product, such as a personal wipe (commonly referred to as a wet wipe or moist towelette), which may be disposable and/or flushable (i.e., may be flushed down a toilet for disposal with other solid waste). Alternatively, the paper product 101 may comprise non-flushable wipes for tabletop use. The paper product 101 may comprise a line of weakness or perforations that define individual sheets. In some embodiments, the cartridge 180 is in the form of a self-contained cartridge where the cartridge 180 completely houses the pre-wetted paper product roll 101. The self-contained cartridge 180 may have the paper product roll 101 preloaded therein as a single use item that contains approximately fifty (50) flushable wipes or baby wipes, or the paper product roll may also be reloaded by the user (i.e., to replace an empty paper product roll 101).

Also, as shown in FIG. 9A, the cartridge 180 further comprises a roller core 108 on which the paper product roll 101 is supported. The opposed ends of the roller core 108 are received within opposed semi-circular notches in the first portion 181 of the cartridge 180 and opposed semi-circular notches in the second portion 182 of the cartridge 180.

In the illustrative embodiment, when the cartridge 180 is refillable, to install the paper product roll 101 in the cartridge 180, the first portion 181 of the cartridge 180 is opened and the paper product 101 is placed into the cartridge 180. A first sheet of the rolled paper product 101 is inserted through an opening 184 in the cartridge 180 such that the sheet extends outward from the top or side of the cartridge 180.

Figure 9B:
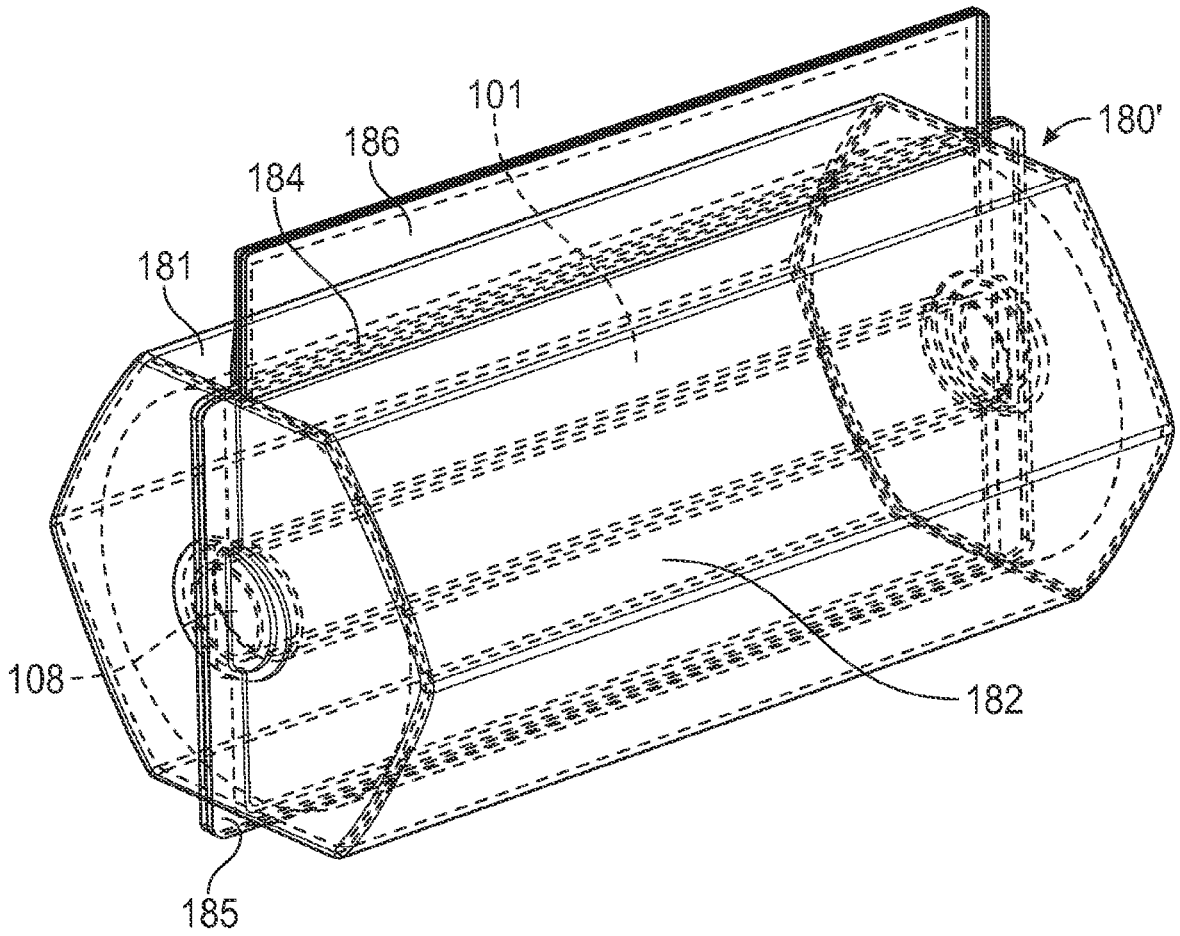
FIG. 9B is another perspective view of the cartridge of FIG. 9A prior to the cartridge extension portion of the cartridge having been removed, wherein a roll of a paper product is disposed in the cartridge.

An initial state of the cartridge is illustrated in FIG. 9B. The cartridge 180' of FIG. 9B is similar in most respects to the cartridge 180 of FIG. 9A, except that FIG. 9B depicts the initial state of the cartridge prior to cartridge extension portion 186 having been removed. In the illustrative embodiment, the cartridge extension portion 186 is made up of two sides, one from the first portion 181 of the cartridge and the other side from the second portion 182 of the cartridge. The illustrative cartridge extension portion 186 has micro-perforations which allows the cartridge extension portion 186 to be separated from the cartridge, therefore, exposing the slot 184 where the wipe exits the cartridge. The initial wet wipe is trapped between the two sides of cartridge extension portion 186 and will be dispensed, thus setting the correct height for the successive wet wipes on the roll. In other words, the cartridge extension portion 186 depicted in FIG. 9B facilitates the positioning of the leading edge of the first wipe at the correct height. The cartridge extension portion 186 maintains the leading edge of the dispensed wipe at a predetermined height so that the wipe is able to be pulled through the rollers 190, 192 and dispensed accurately. As such, the design of the cartridge 180' with the cartridge extension portion 186 advantageously enables the initial wipe height to be accurately set.

Figure 5:
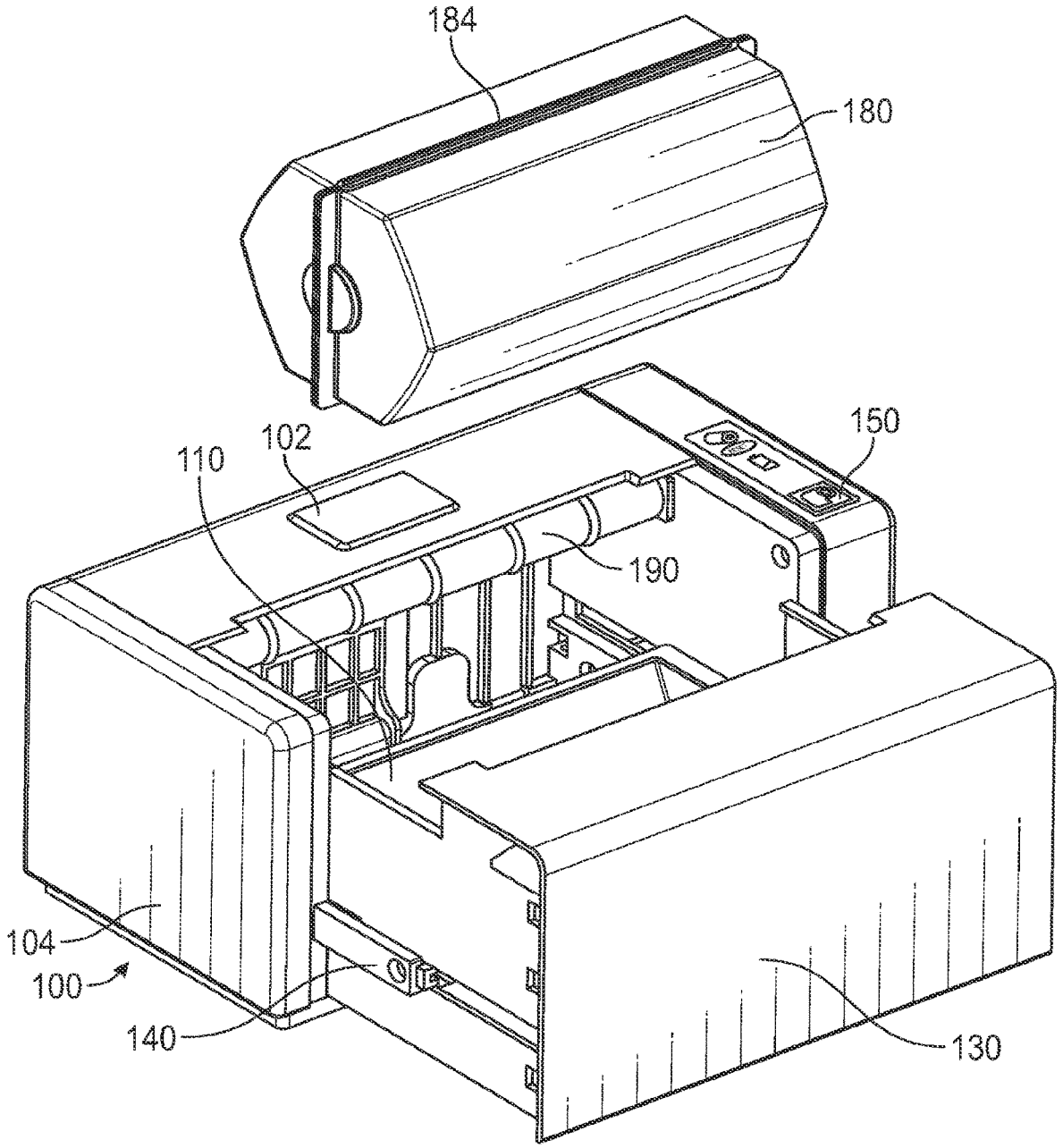
FIG. 5 is a partially exploded view of the dispensing assembly of FIG. 2, where the slidable drawer subassembly of the housing is open, and the cartridge has been removed from the housing.
Figure 7:
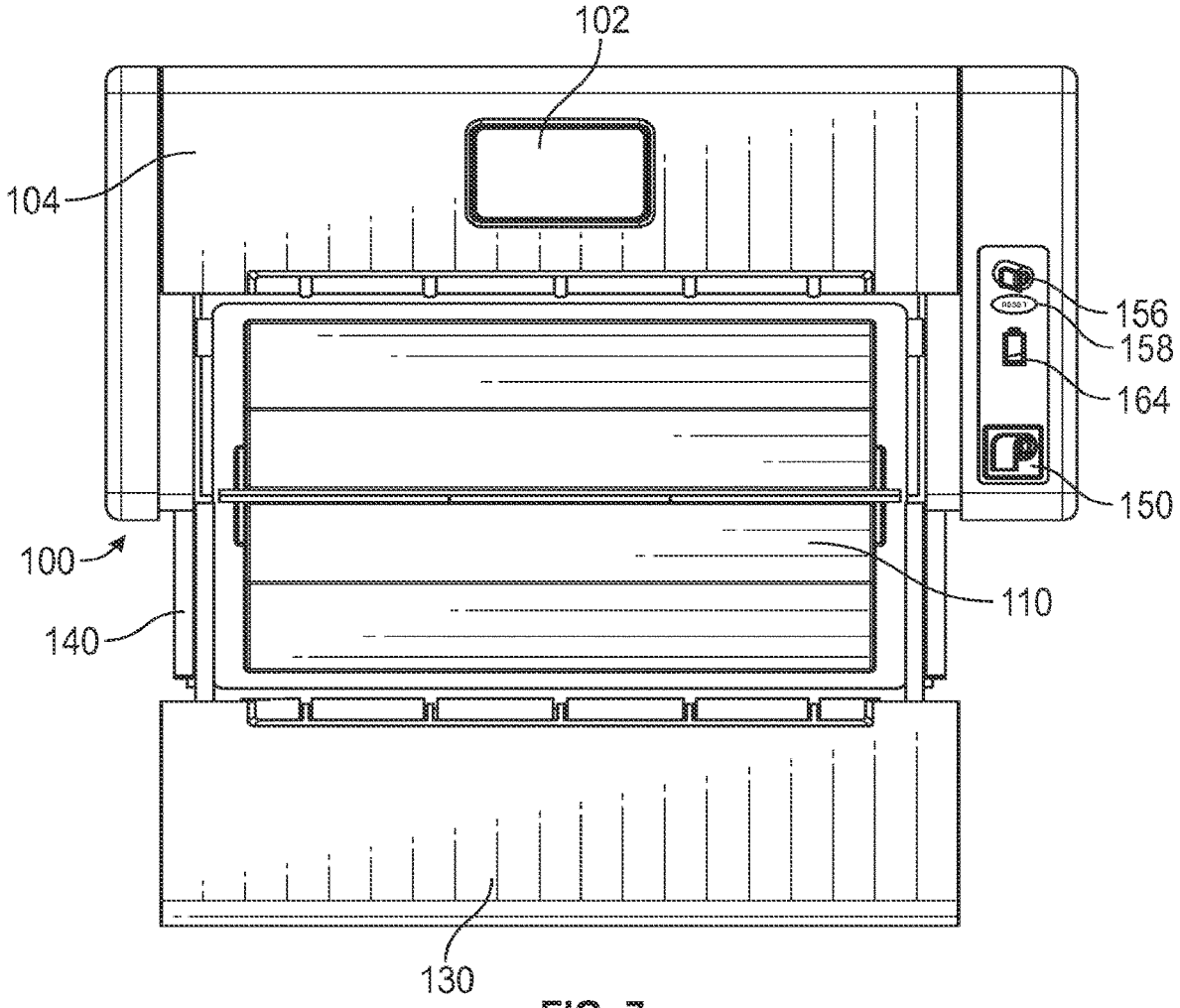
FIG. 7 is a top plan view of the dispensing assembly of FIG. 2, wherein the slidable drawer subassembly of the housing is open so that a cartridge is able to loaded into the cartridge tray of the slidable drawer subassembly.
Figure 8:
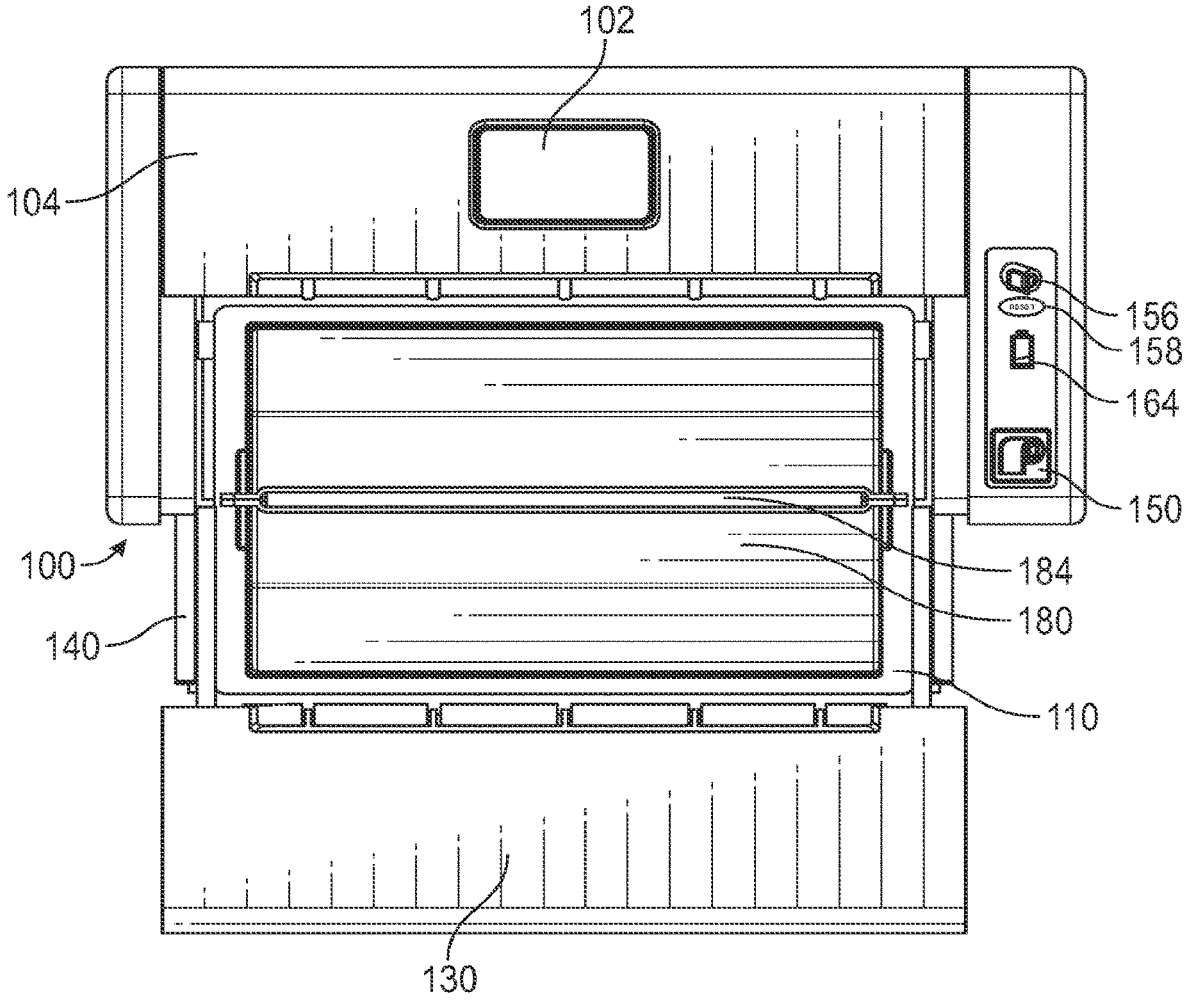
FIG. 8 is another top plan view of the dispensing assembly of FIG. 2, wherein the slidable drawer subassembly of the housing is open, and a cartridge has been loaded into the cartridge tray of the slidable drawer subassembly.
Figure 10B:
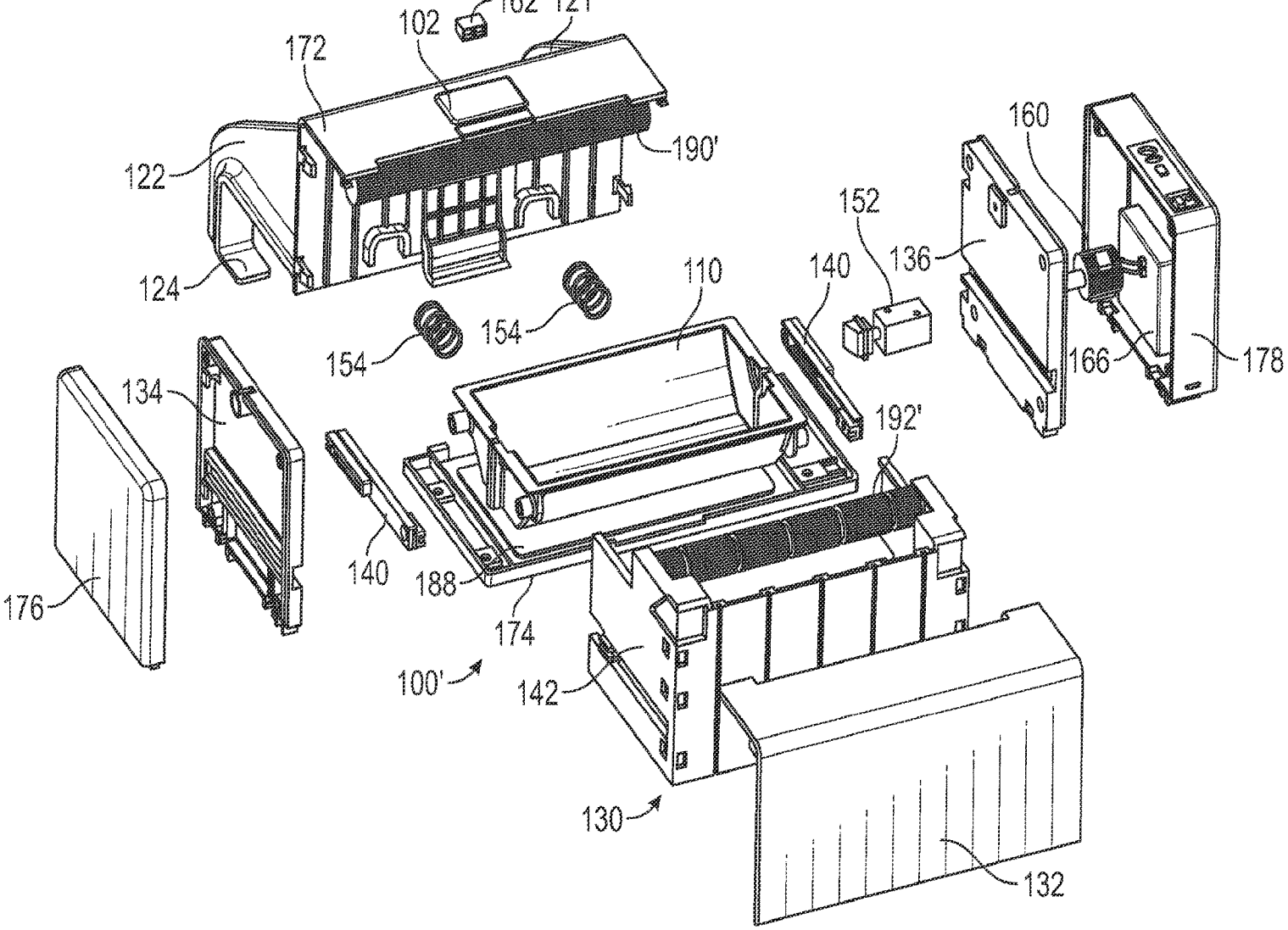
FIG. 10B is an exploded perspective view of a second illustrative embodiment of a dispensing assembly comprising a housing and a cartridge in accordance with principles of the present disclosure.

As shown in the illustrative embodiment of FIGS. 5-8 and 10A, the dispensing assembly 100 further comprises a slidable drawer subassembly 130. In FIGS. 5-7, it can be seen that the slidable drawer subassembly 130 includes a cartridge tray 110 for removably receiving the cartridge 180. Also, as shown in FIGS. 10A and 10B, it can be seen that the slidable drawer subassembly 130 comprises a drawer frame 142. The slidable drawer subassembly 130 is displaceable between a closed position where the cartridge 180 is enclosed within the housing 104 and an open position where the cartridge 180 is able to be loaded or unloaded from the cartridge tray 110. Also, as shown in the exploded view of FIG. 10A, the slidable drawer subassembly 130 comprises the L-shaped front wall 132 disposed on the drawer frame 142, and the compartment of the dispensing assembly 100 that receives the slidable drawer subassembly 130 is bounded on opposed ends by the first and second interior partition walls 134, 136.

Turning again to FIGS. 5 and 6, it can be seen that the slidable drawer subassembly 130 further comprises a double action slide mechanism 140 for allowing the cartridge tray 110 to be displaced between the closed position and the open position. In the illustrative embodiment, the double action slide mechanism 140 allows for the cartridge tray 110 to move independently from the drawer. The primary purpose of the double action slide mechanism 140 is so that the cartridge tray 110 can move into a position where the cartridge 180 can freely drop in. This feature allows for the least amount of opening for placement of the cartridge 180 into the cartridge tray 110. In the illustrative embodiment, the double action slide mechanism 140 comprises a pair of telescoping rails on each side of the drawer 130 for enabling the drawer 130 to extend out further than the depth dimension of the drawer 130. In the illustrative embodiment, referring to FIGS. 3 and 5, the dispensing assembly 100 further comprises an active roller 190 and a passive roller 192. In the illustrative embodiment, the active roller 190 is driven by the actuation subassembly, and the passive roller 192 is spring-loaded (e.g., by two springs) so as to compress the paper product between the passive roller 192 and the active roller 190. When the slidable drawer subassembly 130 is moved into the closed position, the passive roller 192 of the dispensing assembly 100 compresses the paper product 101 dispensed from the cartridge 180 against the active roller 190 such that the active roller 190 and the passive roller 192 together form a seal across the slot through which the paper product 101 is dispensed. This seal may be partially watertight, which helps to reduce loss of moisture from the paper product 101. Compression of the paper product 101 between the active roller 190 and the passive roller 192 also helps to prevent retraction or withdrawal of the paper product 101 back through a housing slot 126 and into the cartridge 180. As described in more detail herein, the active roller 190 and the passive roller 192 cooperate to dispense sheets (e.g., one dispensed sheet at a time) of the paper product 101 via the cartridge opening 184 and aligned housing slot 126 in the front or top of the housing 104 (see FIGS. 1A and 3).

In the illustrative embodiment, the passive roller 192 may be in a form of a grooved passive roller that accepts protrusions or teeth to enhance the dispensing of the paper product 101. For example, as shown in FIG. 10A, in these one or more embodiments, the passive roller 192 may be injection molded with a series of small annular grooves or indentations 196 spaced apart along the length of the passive roller 192. The small grooves or indentations 196 between the sections of the roller 192 allow for small annular protrusions or teeth 194 on the active roller 190 to fit inside the grooves (see FIG. 10A). In the illustrative embodiment, the rounded protuberances 194 on the active roller 190 create tongues which match the grooves 196 in the passive roller 192 so as to assist in the reliable dispensing of wet wipes (refer to FIG. 10A).

In one or more alternative embodiments, protrusions or teeth may be molded in the housing 104 of the unit 100. This construction of the dispensing assembly 100 is similar to a "tongue and groove" configuration used in other applications. Advantageously, in these one or more alternative embodiments, the protrusions or teeth elevate the paper product 101 off the passive roller 192 as the unit 100 is dispensing. This prevents the paper product 101 from rolling around the roller 192, thereby increasing the reliability of the unit 100. In one or more alternative embodiments, the dispensing assembly 100 may comprise protrusions or teeth on the edge of the lower-case side that interface with the grooved passive roller 192.

In the illustrative embodiment, as shown in FIGS. 1A, 2, and 4-6, the dispensing assembly 100 further comprises a release button 102 for opening the slidable drawer subassembly 130 of the dispensing assembly 100. The release button 102 is operatively coupled to the slidable drawer subassembly 130 such that a depressing of the release button 102 compresses springs 120 in FIG. 10A and releases the latch 116, thereby enabling the slidable drawer subassembly 130 to open.

Referring to the exploded view of FIG. 10A, it can be seen that the release button 102 is operatively coupled to the drawer release mechanism 116. In the illustrative embodiment, the drawer release mechanism 116 comprises a spring-loaded latch that holds the slidable drawer subassembly 130 in the closed position. Pushing inwardly on the release button 102 disengages the latch, which allows the drawer 130 to open. The button 102 and the latch 116 are separate pieces and get screwed together, plus there are pieces to hold the latch in place and contain small springs 120. Downward pressure on the button 102 causes a downward displacement, compressing of the springs 120, and releasing of the latch 116 such that the drawer 130 is able to open. In the illustrative embodiment, the springs 120 maintain the release mechanism 116 in the engaged, latched position until the release button 102 is pressed by a user.

With reference to FIG. 5, a portion of the housing 104 adjacent to the housing compartment may further comprise an actuator compartment that encloses the various components of the actuation subassembly. The actuator compartment may be defined on five sides by the housing 104, and on a sixth side by the housing interior wall 136. In the illustrative embodiment, the actuator compartment is disposed on the end of the housing with actuation button 150.

Now, with reference to FIGS. 3 and 5, the actuation subassembly of the dispensing assembly 100 will be described in detail. In the illustrative embodiment, the actuation subassembly may comprise a drive gear (e.g., a spur gear), a gear box, and a direct drive electric motor 160 (see e.g., FIG. 10A, the drive gear and gear box may be provided as part of the motor assembly 160). The drive gear may be operatively coupled to the direct drive motor 160 via the gear box, which adjusts the rotational output (i.e., the speed and torque) of the direct drive motor 160. In turn, the drive gear is operatively coupled to the active roller 190. When the actuation button 150 (see e.g., FIGS. 1A and 2) is depressed on the front of the housing 104, the drive gear and the active roller 190 rotate a predefined rotational distance to advance the paper product 101. In the illustrative embodiment, the actuation subassembly may further comprise a control board disposed in the housing 104 for the controlling the operation of the actuation subassembly.

In the first illustrative embodiment, the direct drive motor 160 is electrically powered by batteries 168 (e.g., four (4) disposable AA size batteries 168), which are located in a battery compartment 138 of the housing 104 (see FIG. 10A) and are accessible for replacement by means of a removable battery compartment door 170.

The electronic control circuit of the control board performs various functions in the illustrative embodiment of the dispensing assembly 100. First, the electronic control circuit of the control board results in the dispensing of exactly one pre-moistened wipe from the internal cartridge 180 for each press of the actuation button 150. Secondly, the electronic control circuit of the control board turns off the drive motor 160 at the correct time so that the perforation on the wipe product generally aligns with the dispensing slot 126. This allows the dispensed product to easily be retrieved by the user by separating the single dispensed wipe from the device. In the illustrative embodiment, the electronic control circuit may be implemented using commercially available electronics components on a custom printed circuit board (PCB). The circuit design utilizes common analog and digital design techniques. Logic control may be achieved using a microcontroller with custom software, digital logic timer/counter integrated circuits, or a combination of these.

In the illustrative embodiment, when a user presses the actuation button 150 with his or her finger on the front of the housing 104 (see e.g., FIGS. 1A and 2), a control signal is sent to the control board. Upon the depressing of the button 150, the control circuit in the control board turns the drive motor 160 on and also starts a timer. The timer's expiration time is pre-programmed to be slightly longer than the typical time required to dispense a single wet wipe.

In the illustrative embodiment, the actuation button 150 may be in a form of a microswitch on a membrane switch pad. The membrane switch pad may have a plurality of different functions and/or indicators that are used on the dispensing assembly 100. In the illustrative embodiment, the membrane switch pad with the actuation button 150 has four functions that may include: (i) dispense wipe by depressing button 150, (ii) low battery indicator 164 (see e.g., indicator light 164 in FIGS. 1A and 2), (iii) low wipe indicator 156 (see e.g., indicator light 156 in FIGS. 1A and 2), and (iv) device reset (see e.g., reset button 158 in FIGS. 1A and 2). The first function may be performed by an activation switch on the membrane switch pad that powers up the electric motor 160, which moves the active roller 190. The second function may be performed by a low battery indicator light emitting diode (LED) 164 on the membrane switch pad. The third function may be performed by a low wipe count LED indicator 156 on the membrane switch pad, which is illuminated based upon a determination of the number of revolutions that the active roller 190 has moved through. In the illustrative embodiment, the control board of the dispensing assembly 100 uses a signal from an encoder on the motor 160 to determine the number of wipes dispensed, and thus illuminates the low wipe count LED indicator 156 when number of wipes is determined to be low. The fourth function may be performed by a reset switch or button 158 on the membrane switch pad which is used to zero out the wipe count and bring the number back to zero when a new cartridge 180 is inserted into the device 100 by the user. The encoder on the motor 160 counts the number of revolutions of the active roller 190. The encoder counts the revolutions and stops the motor 160 when the number of revolutions equals a single wet wipe. The total number of revolutions is counted and when 95% of the wipes are dispensed, the LED indicator 156 will light up indicating a low wipe count.

In one or more embodiments, when the drive motor 160 is activated by the control circuit in the control board, the drive motor 160 rotates the gear box components, which in turn, rotates the drive gear. Rotation of the drive gear causes the active roller 190 to rotate a corresponding rotational distance. This rotation of the active roller 190 causes the sheet of the rolled or stacked paper product 101 extending from the slot 126 to move outwardly from the housing 104. In this manner, sheets of the paper product 101 are dispensed one at a time from the cartridge 180. Compression of the paper product 101 between the active roller 190 and the passive roller 192 keeps the paper product 101 from retracting back into the cartridge 180 between depressions of the actuation button 150. Upon depletion of the paper product 101, the cartridge 180 may be removed from the housing 104 as described herein for refilling or disposal (see FIG. 5).

In one or more alternative embodiments, rather than the actuation button 150 being in a form of a microswitch on a membrane switch pad, the actuation button 150 may be a single electromechanical actuation button where the pressing of the actuation button by the user depresses a microswitch which, in turn, powers up the electric motor 160, and thereby moves the active roller 190.

In a second illustrative embodiment, with reference to FIG. 10B, rather using the mechanical release button 102 for opening the slidable drawer subassembly 130, the dispensing assembly 100' is provided with a solenoid release device 152. The drawer release function may be performed by an electrical release button 102 on the front or top of the housing 104, which when pressed by a user, sends an electrical signal to the solenoid release device 152 that results in the release of a solenoid pin, thereby causing the slidable drawer subassembly 130 of the unit 100 to open. When solenoid pin is released, the slidable drawer subassembly 130 is unlatched, and spring forces exerted by the large springs 154 are able to push the drawer 130 open (see FIG. 10B). That is, the drawer 130 is spring-loaded such that the springs 154 assist in the opening of the drawer 130 once an electrical release button is pressed by a user, and the solenoid pin is released. In the second illustrative embodiment, this electrical release feature replaces the mechanical release button 102 and release mechanism 116 of the drawer 130 described above for the first embodiment, thereby allowing the release to be electrically activated instead of mechanically activated.

In the second illustrative embodiment, with reference again to FIG. 10B, the dispensing assembly 100' may further comprise an infrared reader/sensor 162 to facilitate the controlled dispensing of an individual sheet of the paper product 101 (e.g., a single wet wipe). In these one or more embodiments, the function of the sensor 162 is to detect a portion of a sheet after the prior sheet is torn off by the consumer and cause the motor 160 to reverse until no portion of the subsequent sheet is detected. This allows for the smallest amount of sheet surface to be exposed to air, thereby reducing moisture loss for a moistened sheet (e.g., a wet wipe). As such, in the illustrative embodiment, the motor 160 is in the form of a bidirectional motor that is electrically coupled to the infrared reader/sensor 162 so that proper substrate height can be consistently present after each dispensing. Also, the infrared reader/sensor 162 may be configured to detect the appropriate height of the leading edge of the sheet substrate. In these one or more embodiments, the infrared sensor may have a configuration that is similar to infrared sensor 256 described in commonly owned U.S. Pat. No. 11,051,663, the disclosure of which is hereby incorporated by reference in its entirety.

In the second illustrative embodiment, rather than being powered by the disposable batteries 168, the direct drive motor 160 of the dispensing assembly 100' is electrically powered by a rechargeable battery pack 166, which is located in the end cap 178 of the housing 104 (see FIG. 10B). A charging port is provided on the exterior of the end cap 178 that receives the plug of a charging cord for charging the rechargeable battery pack 166. The low battery indicator light emitting diode (LED) 164 described above may be used with the rechargeable battery pack 166 in the same manner described above for the disposable batteries 168 and may be configured to illuminate when a low voltage state of the rechargeable battery pack 166 occurs.

In the second illustrative embodiment, as shown in FIG. 10B, the dispensing assembly 100' may further comprise a warming tray for heating the paper product 101 in the cartridge 180. For example, as depicted in FIG. 10B, a thin metal sheet 188 may be attached to the interior top surface of the bottom wall 174 for operating as a resistance heating element for heating the cartridge 180. The thin metal sheet 188 may be electrically coupled to the low voltage source of the dispensing assembly 100' for creating a constant low temperature heat source for the purpose of warming the cartridge 180 and the paper product 101 disposed therein.

In the second illustrative embodiment, rather than being provided with rollers 190, 192 having the tongue and groove arrangement described above for the first illustrative embodiment, the active roller 190' and the passive roller 192' are in a form of gear drive rollers (see FIG. 10B) that mating engage with one another in a gear-like manner. As shown in FIG. 10B, the active roller 190' has elongated teeth that interface with corresponding teeth on the passive roller 192'. The gear-type configuration of the active and passive rollers 190', 192' of the dispensing assembly 100' in the second illustrative embodiment eliminates the compression aspect of the rollers so the fluid in substrate 101 is maintained on dispensing.

In one or more embodiments, the dispensing assembly 100 may further comprise an encoder on the electric motor to measure the number of revolutions of the active roller 190. The encoder then stops the motor from rotating so as to result in the single sheet (e.g., wet wipe) being positioned correctly, thereby allowing the detachment of the sheet (e.g., wet wipe) for use. Based on the length of the sheet (e.g., wet wipe), the number of revolutions of the active roller 190 can be controlled by the encoder.

Figure 11:
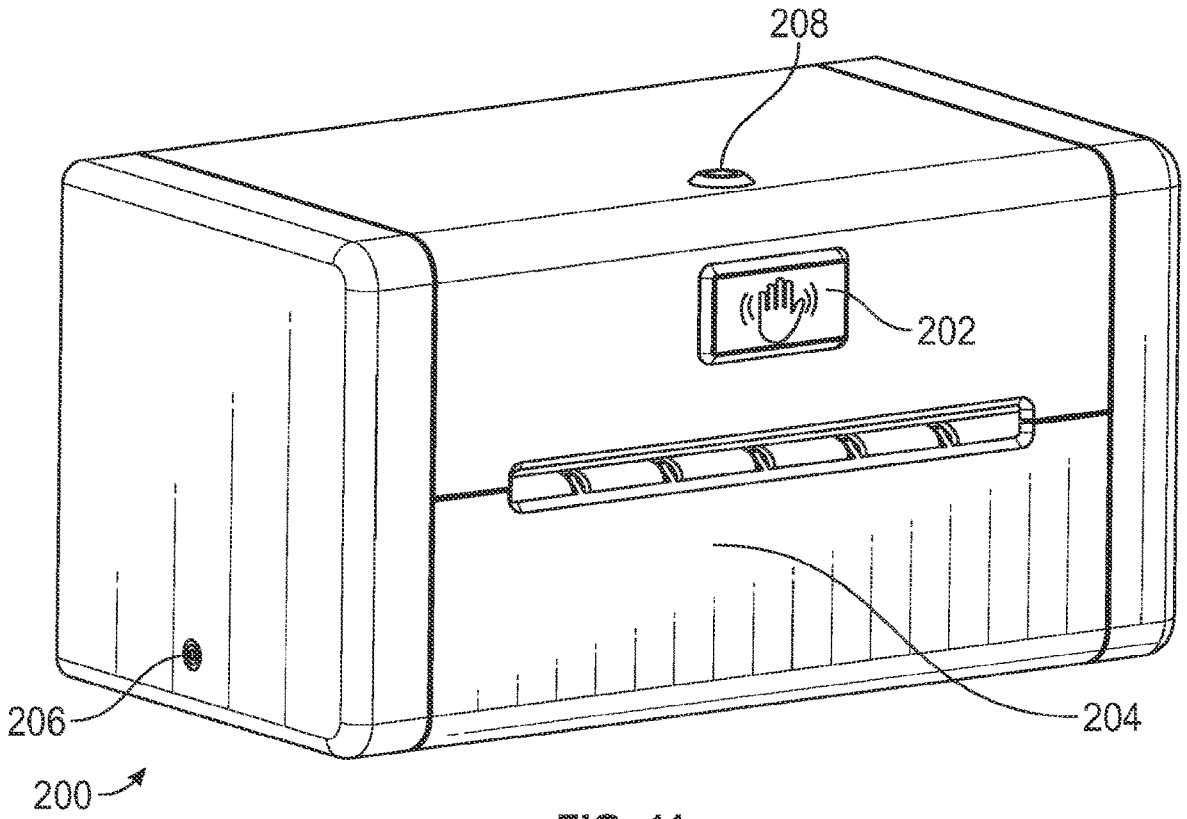
FIG. 11 is a front-top perspective view of a third illustrative embodiment of a dispensing assembly comprising a housing and a cartridge in accordance with principles of the present disclosure, wherein a large tabletop configuration of the dispensing assembly is illustrated.

Now, with reference to FIG. 11, a dispensing assembly 200 in accordance with a third illustrative embodiment of the present disclosure is depicted. In the third illustrative embodiment, for commercial applications of the dispensing assembly 200, the size of both the cartridge tray and the unit 200 itself may be enlarged. For example, the cartridge of the unit 200 may be designed to accept a roll of the paper product (e.g., a roll of wet wipes) where each sheet on the roll is approximately 6.5 inches wide by approximately 7 inches long. In this further embodiment, the number of individual sheets is increased to one hundred (100) sheets or wipes per cartridge with the increased size of the cartridge. To accommodate the larger cartridge size, the dispensing unit 200 is increased in size, and is powered by low voltage or standard 120-volt building power instead of battery power. For example, as shown in FIG. 11, the dispensing assembly 200 may be provided with a power port or receptacle 206 for receiving a plug of a low voltage power cord or a standard 120-volt building power cord. The low voltage power source or standard 120-volt building power may be used to power the electric motor 160, the solenoid release device 152, and the wipe warming device 188 described above, rather than the rechargeable battery pack 166 or the disposable batteries 168. In this further embodiment, the enlarged unit is designed to be directly mounted on a surface with direct wiring. Unlike the embodiment described above, this larger, commercial version of the dispensing assembly 200 is not designed to be hung from a spindle (e.g., a toilet paper roll core). When standard 120-volt building power is used for powering the dispensing unit 200, a step-down transformer/rectifier may be included to reduce the incoming voltage and/or convert the incoming alternating current (AC) to direct current (DC).

Referring again to FIG. 11, it can be seen that, in the third illustrative embodiment, the front of the housing 204 is provided with a touchless actuator or switch 202 for dispensing the wipe from the unit 200, rather than the dispensing button 150 described above in conjunction with the first illustrative embodiment. In addition, as shown in FIG. 11, the commercial embodiment of the dispensing assembly 200 may comprise a drawer locking mechanism 208 disposed on the top of the housing 204 so that the slidable drawer subassembly 130 is not able to be opened unless the user has a key. In the third illustrative embodiment, the drawer locking mechanism 208 may be in a form of a keyed switch which releases the slidable drawer 130 by activating the solenoid latch 152 described above in conjunction with FIG. 10B. As such, in the third illustrative embodiment wherein the dispensing assembly 200 may be used for commercial applications, the slidable drawer 130 cannot be opened without a key.

In the third illustrative embodiment, the dispensing assembly 200 may incorporate many of the features described above in conjunction with the exploded view depicted in FIG. 10B. For example, the dispensing assembly 200 may include the solenoid release device 152, the gear-type active and passive rollers 190', 192', and the wipe warming device 188.

A dispensing assembly in accordance with the present disclosure provides a number of advantages over known combination dispensers. For example, attachment of the dispensing assembly to a fixed substrate such as a wall-mounted, toilet tissue holder places the personal wipes within easy reach for use in combination with dry paper products such as a conventional toilet tissue roll. There is generally no need to install an additional or specific holder, especially for the dispensing assembly, as the housing can typically be installed on an existing holder. There is also generally no need to modify the existing holder, the wall, or any other adjacent structure to accommodate the dispensing assembly. The compact housing hangs below the fixed substrate to take advantage of unused space, while allowing unencumbered access to the dry paper products positioned above the compartment that receives the cartridge. The cartridge may accommodate a variety of different rolled and stacked wet paper products and provides for easy installation and removal by a consumer. The cartridge helps to prevent moisture loss in the case of a pre-wetted paper product by enclosure of the paper product on all sides and formation of a seal between the active and passive rollers near the slot from which the paper product is dispensed. The cartridge may be reusable and/or refillable, and the housing and cartridge may be recycled at the end of their life cycles.

Any of the features or attributes of the above-described embodiments and variations can be used in combination with any of the other features and attributes of the above-described embodiments and variations as desired.

Having thus described the invention of the present application in detail and by reference to embodiments thereof, it will be apparent that modifications and variations are possible without departing from the scope of the invention defined in the appended claims.

The invention claimed is:

1. A dispensing assembly, comprising:

a housing;

a cartridge configured to dispense a paper product;

an actuation subassembly associated with the housing, the actuation subassembly being configured to advance the paper product from the cartridge; and a slidable drawer subassembly, the slidable drawer subassembly being displaceable between a closed position and an open position.

2. The dispensing assembly according to claim 1, wherein the slidable drawer subassembly includes a cartridge tray for removable receiving a cartridge and a double slide mechanism for allowing the cartridge tray to be displaced between the closed position and the open position.

3. The dispensing assembly according to claim 1, wherein, when the slidable drawer subassembly is moved into the closed position, one or more rollers of the dispensing assembly are configured to compress the paper product dispensed from the cartridge.

4. The dispensing assembly according to claim 1, wherein the dispensing assembly further comprises an active roller and a passive roller, wherein the active roller is driven by the actuation subassembly, and wherein the passive roller is spring-loaded so as to compress the paper product between the passive roller and the active roller.

5. The dispensing assembly according to claim 4, wherein the passive roller further comprises a plurality of spaced-apart grooves formed therein, each of the plurality of spaced-apart grooves being configured to receive a respective tooth member in the active roller to facilitate a reliable dispensing of the paper product.

6. The dispensing assembly according to claim 1, further comprising a mechanical release button for opening the slidable drawer subassembly of the dispensing assembly, the mechanical release button being operatively coupled to a spring-loaded mechanical latching device such that a depressing of the mechanical release button releases the spring-loaded mechanical latching device for allowing the slidable drawer subassembly to open.

7. The dispensing assembly according to claim 1, wherein the cartridge further comprises a first portion and a second portion, the first portion of the cartridge being hingedly connected to the second portion.

8. The dispensing assembly according to claim 1, wherein the actuation subassembly further comprises a drive gear, a drive motor, and a membrane switch pad, wherein the drive gear is operatively coupled to the drive motor and to an active roller in the housing, and wherein the membrane switch pad includes a first switch for rotating the drive gear and the active roller a predefined rotational distance to advance the paper product.

9. The dispensing assembly according to claim 8, wherein the actuation subassembly further comprises a second switch for resetting a wipe count to zero when a new cartridge is inserted into the dispensing assembly by a user.

10. The dispensing assembly according to claim 1, wherein the actuation subassembly further comprises a first indicator light for indicating a low battery condition of the dispensing assembly and a second indicator light for indicating a lower sheet count of the paper product.

11. The dispensing assembly according to claim 1, further comprising a hanger component attached to the housing, the hanger component comprising a pair of arms that suspend the housing below a spindle and a plurality of attachment protrusions that are configured to snap into corresponding recesses formed in the housing so as to removably attach the hanger component to the housing.

12. The dispensing assembly according to claim 1, wherein the cartridge is configured to be inserted into a front of the housing by means of the slidable drawer subassembly.

13. The dispensing assembly according to claim 1, wherein the paper product comprises cleaning wipes disposed on a roll.

14. The dispensing assembly according to claim 1, further comprising a sensor device configured to detect a portion of a sheet of the paper product after a prior sheet of the paper product has been torn off by a user, and cause a drive motor to reverse until no portion of the sheet is detected by the sensor device, thereby allowing for a smallest amount of sheet surface of the sheet to be exposed to air so as to reduce moisture loss from the sheet when the sheet has been pre-moistened.

15. The dispensing assembly according to claim 1, further comprising an encoder provided on a drive motor to measure a number of revolutions of an active roller, an output signal of the encoder being used to indicate when to stop the drive motor from rotating so as to result in a sheet of the paper product being positioned correctly, thereby facilitating a proper detachment of the sheet for use.

16. The dispensing assembly according to claim 1, wherein the dispensing assembly is configured to be mounted to a surface of a support structure, and a drive motor of the dispensing assembly is configured to be powered by a low voltage power source or a 120-volt building power source.

17. The dispensing assembly according to claim 1, further comprising an electrical release button for opening the slidable drawer subassembly of the dispensing assembly, the electrical release button being operatively coupled to a solenoid latching device such that a depressing of the electrical release button releases a solenoid pin of the solenoid latching device for allowing the slidable drawer subassembly to open, the solenoid latching device configured to be powered by a low voltage power source or a 120-volt building power source.

18. The dispensing assembly according to claim 1, further comprising a heating element for heating the paper product in the cartridge, the heating element being mounted on one the housing adjacent to the cartridge tray, and the heating element configured to be powered by a low voltage power source or a 120-volt building power source.

19. The dispensing assembly according to claim 1, further comprising a touchless actuator or switch for dispensing the paper product from the dispensing assembly; wherein, when a user places his or hand in close proximity to the touchless actuator or switch, an active roller of the dispensing assembly is configured to be rotated a predefined rotational distance so as to advance the paper product and dispense the paper product from the dispensing assembly.

20. A dispensing assembly, comprising:

a housing;

a cartridge configured to dispense a paper product;

an actuation subassembly associated with the housing, the actuation subassembly configured to advance the paper product from the cartridge; and wherein the cartridge comprises a cartridge extension portion extending outwardly a cartridge dispensing slot of the cartridge, the cartridge extension portion acting as a guide for the proper positioning of a leading edge of a first sheet of the paper product so as to set the proper positioning for the successive sheets of the paper product, and the cartridge extension portion being perforated so as to allow the cartridge extension portion to be separated from a remainder of the cartridge after the leading edge of the first sheet of the paper product has been properly positioned.

* * * * *